US006175969B1

(12) United States Patent
Edwards

(10) Patent No.: US 6,175,969 B1
(45) Date of Patent: Jan. 23, 2001

(54) BOAT-SUPPORTED WATER MISTING AND COOLING APPARATUS

(76) Inventor: Hugh A. Edwards, 4004 Cape Vista Dr., Bradenton, FL (US) 34209

( * ) Notice: Under 35 U.S.C. 154(b), the term of this patent shall be extended for 0 days.

(21) Appl. No.: 09/349,371

(22) Filed: Jul. 8, 1999

Related U.S. Application Data

(63) Continuation-in-part of application No. 09/150,308, filed on Sep. 9, 1998.

(51) Int. Cl.[7] ..... E04H 4/00

(52) U.S. Cl. ..... 4/496; 4/661; 239/289; 239/207; 239/208

(58) Field of Search ..... 4/496, 488, 567, 4/568, 570, 661; 239/207, 209, 208, 266, 286, 289; 47/17, 26, 48.5; 248/223, 62, 231.21

(56) References Cited

U.S. PATENT DOCUMENTS

| | | | | |
|---|---|---|---|---|
| 917,157 | | 4/1909 | Sandham . | |
| 3,337,136 | | 8/1967 | Strenkert . | |
| 3,499,580 | * | 3/1970 | Smith | 222/61 |
| 3,504,825 | * | 4/1970 | Diamond et al. | 222/61 |
| 3,606,157 | | 9/1971 | Chapin . | |
| 4,788,791 | | 12/1988 | Sprung . | |
| 4,791,993 | | 12/1988 | Curran . | |
| 4,834,186 | | 5/1989 | Ballard . | |
| 5,000,384 | * | 3/1991 | Arnold | 239/128 |
| 5,201,857 | | 4/1993 | Nix . | |
| 5,217,161 | | 6/1993 | Souza . | |
| 5,330,104 | * | 7/1994 | Marcus | 239/266 |
| 5,469,587 | | 11/1995 | Demeny . | |
| 5,598,719 | * | 2/1997 | Jones et al. | 62/304 |
| 5,768,843 | * | 6/1998 | Dziedzic | 52/506.06 |
| 5,785,204 | * | 7/1998 | Thompson et al. | 221/24 |
| 5,862,990 | * | 1/1999 | White | 239/289 |

OTHER PUBLICATIONS

Creative Misting Systems Inc., No Date.*
Niagara Mist, No Date.*
Nevada Mist, No Date.*
Mist Cooling, No Date.*

* cited by examiner

*Primary Examiner*—David J. Walczak
(74) *Attorney, Agent, or Firm*—Charles J. Prescott

(57) ABSTRACT

A boat-supported water misting and cooling apparatus, the boat including tubular framework closely associated with the useful open areas of the boat. The apparatus includes a plurality of water misting nozzles each of which discharge pressurized water as a very fine mist. A flexible water (micro) tubing is operably connectable to each misting nozzle for dispensing pressurized water therefrom, the water tubing also being connectable at the other end thereof to a pressurized water source. Retaining clips are each connectable to a section of tubular framework to support the misting nozzles and water tubing adjacent each open area of the boat whereby mist discharging from the misting nozzles is distributed to cool occupants within each misting zone by evaporation substantially before skin or boat surface contact thus avoiding any substantial water buildup.

3 Claims, 7 Drawing Sheets

FIG. 6
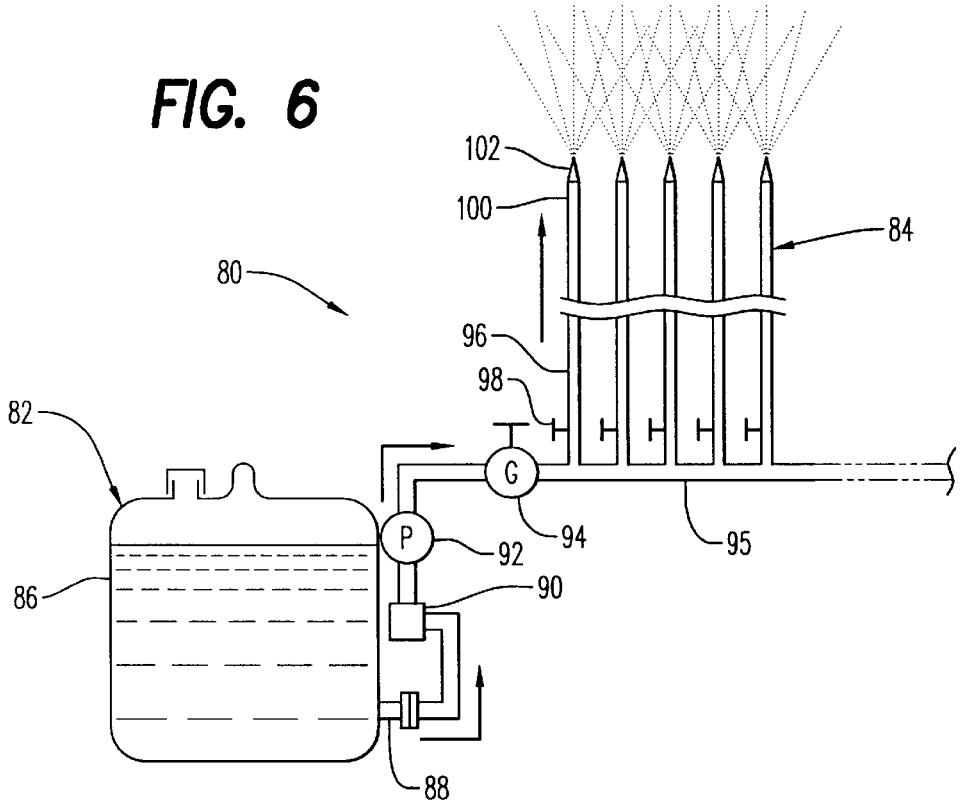
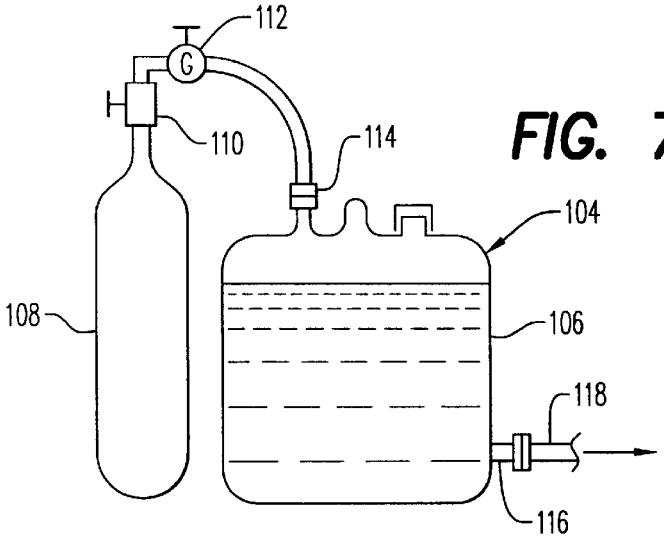
FIG. 7

BOAT-SUPPORTED WATER MISTING AND COOLING APPARATUS

This is a continuation-in-part of U.S. patent application Ser. No. 09/150,308 filed Sep. 9, 1998.

BACKGROUND OF THE INVENTION

1. Scope of Invention

This invention relates generally to boats and marine vessels, and more particularly to an apparatus attachable to the framework of such vessels which dispenses a very fine mist over the open areas thereof for cooling occupants without substantially wetting the boat itself.

2. Prior Art

A number of devices are known to applicant which spray either swimming pool water or fresh water into or adjacent a swimming pool primarily for visual effects or for water level replenishment within the swimming pool itself. The following U.S. patents apply thereto:

U.S. Pat. No. 5,201,857 to Nix

U.S. Pat. No. 5,217,161 to Souza

U.S. Pat. No. 3,831,852 to Stillman

Other prior art teachings are shown in the following additional patents:

U.S. Pat. No. 5,469,587 to Demeney

U.S. Pat. No. 4,834,186 to Ballard

U.S. Pat. No. 4,791,993 to Curran

U.S. Pat. No. 3,337,136 to Strenkert

U.S. Pat. No. 917,157 to Sandham

However, none of the above prior art inventions teach the discharging of a very finely atomized water mist over the open area only for cooling individuals aboard a boat or other such beneficial purposes.

Chapin, in U.S. Pat. No. 3,606,157 teaches a suspended watering system which suspends an elongated water supplying main from a tensioned cable, the main being provided with a series of upstanding spray nozzles connected thereto, the nozzles being independently supported for proper orientation and discharge of water for irrigation purposes.

In U.S. Pat. No. 4,788,791, Sprung has invented a cooling system for greenhouse structures which is attached to the outside surface of a greenhouse translucent screen fabric panel so that water spray is applied to the outer surfaces of the translucent screen fabric for cooling of the greenhouse structure.

There appears to be a need for an apparatus which dispenses a highly atomized very fine mist into the open areas of a boat which typically gets quite hot during the warmer seasonal months. By the dispensing of a highly atomized mist, both the air and the occupants in the open areas aboard the boat are cooled thereby as the mist or highly vaporized water more quickly evaporates than does any other form of water such as when sprayed or sprinkled onto the boat by conventional hose and nozzle means. The present invention responds fully to this need.

BRIEF SUMMARY OF THE INVENTION

This invention is directed to a boat-supported water misting and cooling apparatus, the boat including tubular framework closely associated with the useful open areas of the boat. The apparatus includes a plurality of water misting nozzles each of which discharge pressurized water as a very fine mist. A flexible water (micro) tubing is operably connectable to each misting nozzle for dispensing pressurized water therefrom, the water tubing also being connectable at the other end thereof to a pressurized water source. Retaining clips are each connectable to a section of tubular framework to support the misting nozzles and water tubing adjacent each open area of the boat whereby mist discharging from the misting nozzles is distributed to cool occupants within each misting zone by evaporation substantially before body contact thus avoiding any substantial water buildup.

It is therefore an object of this invention to provide an apparatus for dispersing a highly atomized very fine mist of water vapor into the open areas of a boat which cools occupants by evaporation without substantially wetting the skin or any surfaces of the boat.

It is yet another object of this invention to provide an easily installable system for dispersing very fine mist into the open areas of a boat for cooling of occupants therein.

It is still another object of this invention to provide attaching clips for supporting the misting nozzles of an apparatus for dispensing cooling mist into open areas of a boat, the retaining clips easily mechanically attachable to the existing tubular framework of the boat.

It is still another object of this invention to provide a misting apparatus for a boat which utilizes a separate water pump or a pressurized SCUBA tank as a source for pressurizing water dispensed as a cooling mist by the apparatus.

In accordance with these and other objects which will become apparent hereinafter, the instant invention will now be described with reference to the accompanying drawings.

BRIEF DESCRIPTION OF THE DRAWINGS

FIG. 6 is a side elevation schematic view of another embodiment of the invention for use in conjunction with the open areas of a boat.

FIG. 7 is a side elevation schematic view similar to FIG. 6 which utilizes a SCUBA tank as a source of pressurizing water within the holding tank.

DETAILED DESCRIPTION OF THE INVENTION

SWIMMING POOL CAGE-SUPPORTED EMBODIMENT

Figure 1:
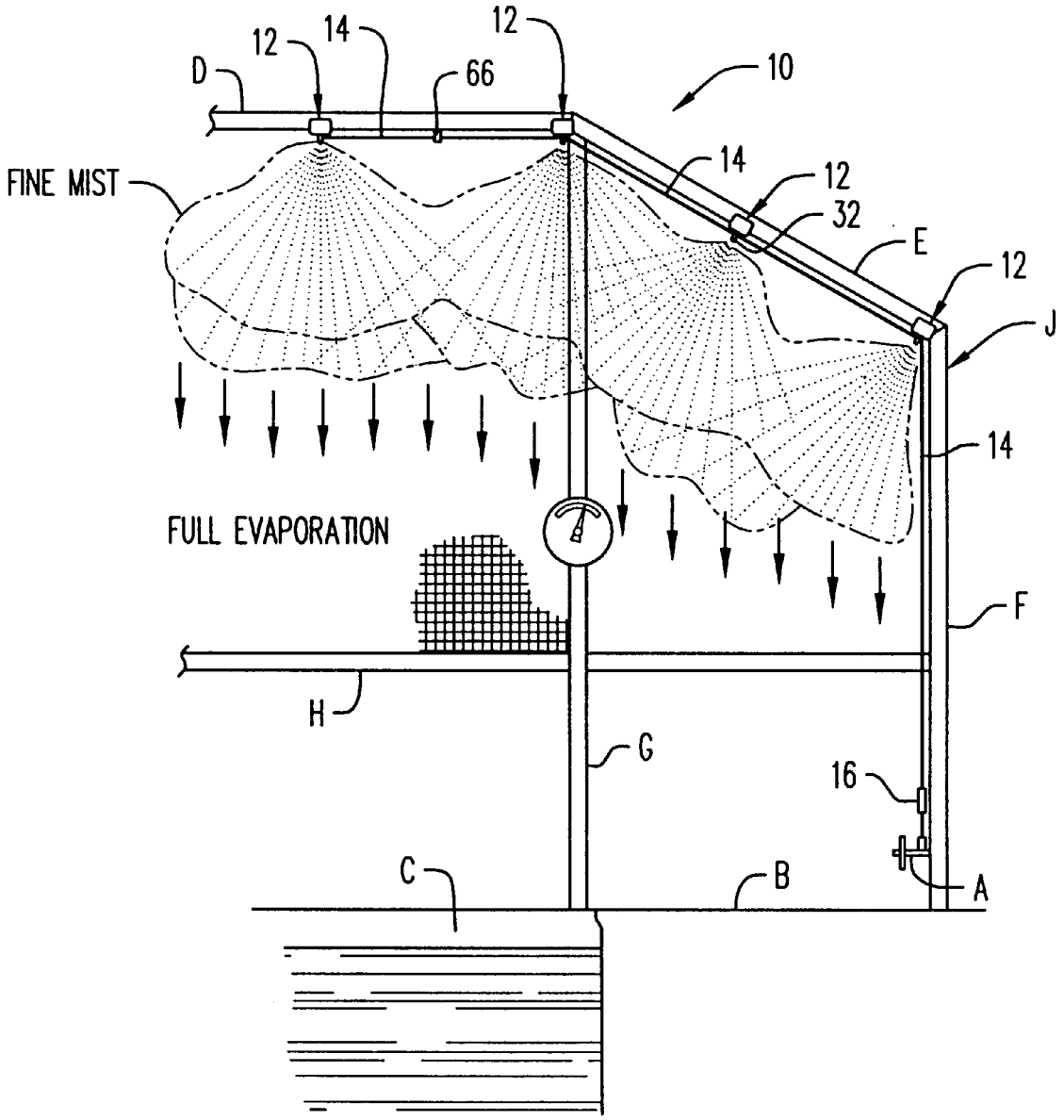
FIG. 1 is a side elevation interior view of a portion of a screen enclosure surrounding a the swimming pool and adjacent deck area.
Figure 2:
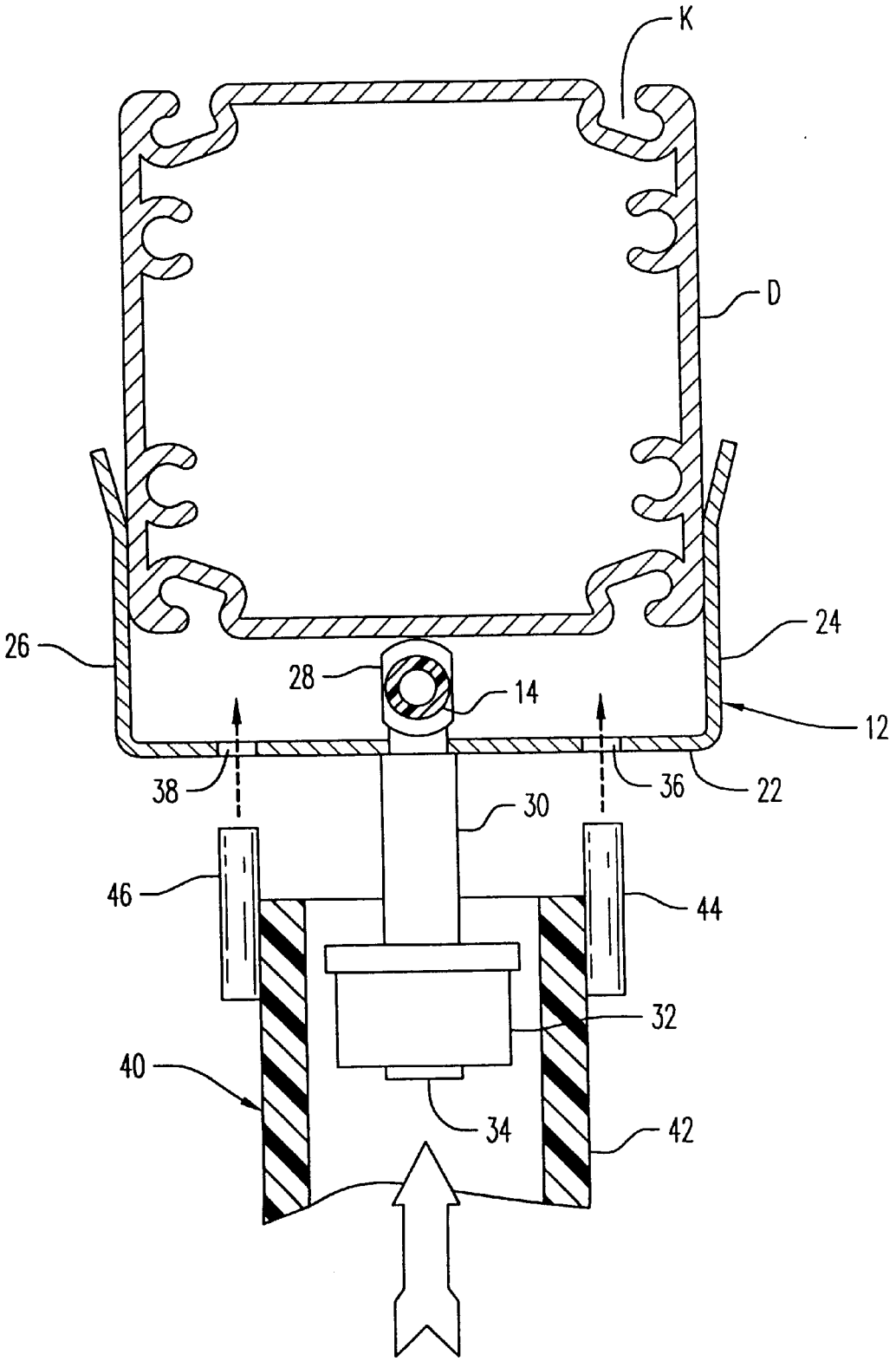
FIG. 2 is a typical cross section view through one frame member of the swimming pool cage or enclosure showing the preferred embodiment of the retaining clip and supportively connected misting nozzle and water conduit and further showing a separate elongated retaining clip installation tool used to facilitate apparatus installation while standing on the deck area or in the pool.

Referring now to the drawings, one embodiment of the invention is shown in FIG. 1 generally at numeral 10 and includes a plurality of retaining clip assemblies 12 as best seen in FIG. 2, each of which include a generally U-shaped clip or bracket 22 which is attached and inwardly (or downwardly) extends from one elongated rigid frame member D or E of a frame structure of a swimming pool cage or enclosure shown generally at numeral J. Opposing side portions 24 and 26 biasingly engage against the side surfaces of the frame member D for support, which support may be increased by the addition of a rubber sheet or adhesive strips.

Each of the retaining clip assemblies 12 include and support one fogger or misting nozzle 32 as best seen in FIG. 2. These misting nozzles 32 are commercially available from the Dig Corporation of San Marcos, California in various sizes and degrees of water atomization, P/N43 fogger being preferred.

A length of flexible water (micro) tubing or conduit 14 (also available from Dig Corporation) is interconnected between each misting nozzle 32 and then connected at a lower end thereof to a supply of pressurized water from valve A. To insure proper pressurization, a regulating valve 16 which maintains a desired pressure and water flow rate is also provided. The preferred water pressure is a maximum of about 50 p.s.i. and preferably in the range of 25–30 p.s.i. Although fresh water is the preferred source of pressurized water from a municipal water supply, to conserve on fresh water use, an alternate water supply may be obtained by tapping into the outlet side of a water filter and circulation system (not shown) of a swimming pool C. Each said misting nozzle 32 delivers about 4–5 g.p.h. (gallons per hour) at 25–30 p.s.i.

To facilitate installation of each retaining clip assembly 12 which also preferably carries a misting nozzle 32, an elongated retaining clip installation device 40 as best seen in FIG. 2 is provided. This installation device 40 includes spaced prongs or locating dowels 44 and 46 which axially extend from the distal end of an elongated lightweight plastic tubular handle 42. The interior or inside diameter of the handle 42 is sized to somewhat closely fit around the outer periphery or diameter of the misting nozzle 32 to assist in the alignment of prongs 44 and 46 into mating holes 36 and 38 formed into the retaining clip 22. Once the retaining clip 22 has been forcibly urged into the position shown in FIG. 2 and attached to the inward portion of the frame member D, the installation member 40 may be removed. By this accessory, an installer may stand on the deck area B of the swimming pool C (or in the pool) within the enclosure J of FIG. 1 and easily properly install each of the retaining clip assemblies 12. A lower end (not shown) of the installation device 40 may be connected to another expandable pole for greater reach, if necessary.

Figure 3:
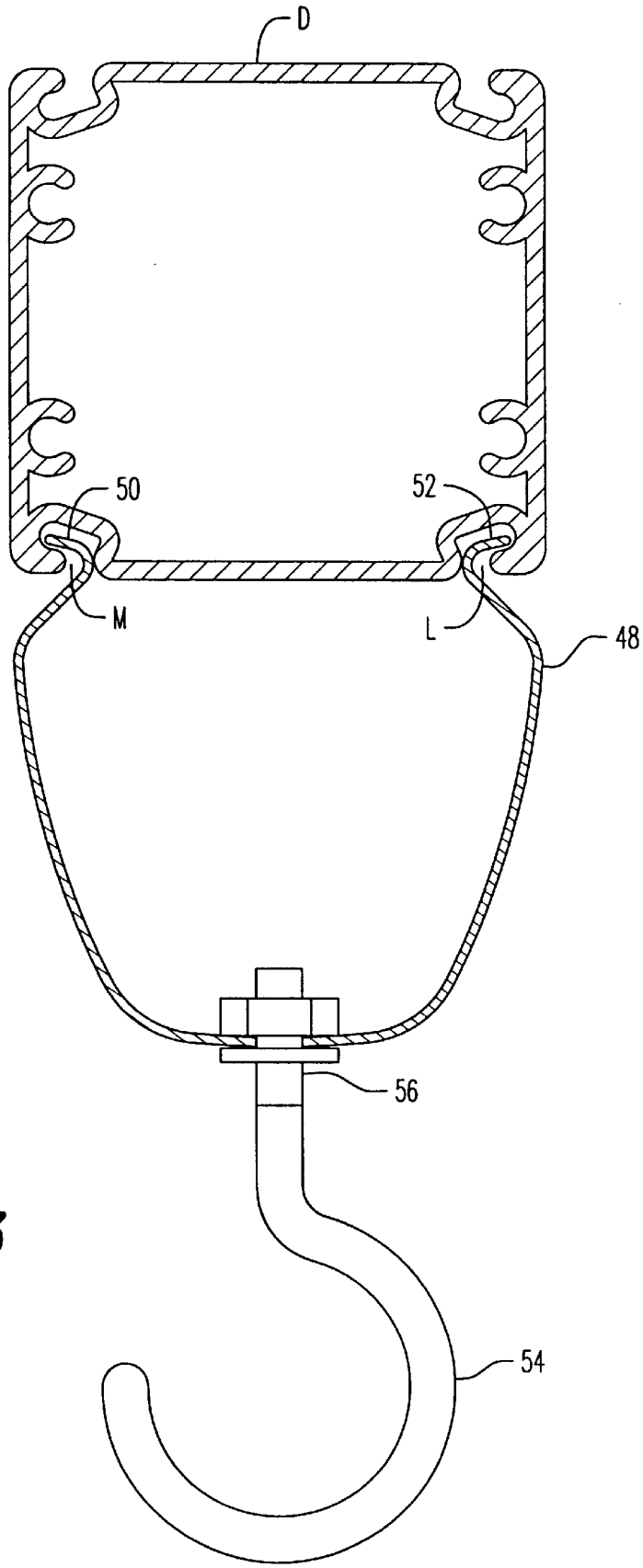
FIG. 3 is another cross section view taken through a typical frame member showing another embodiment of a retaining clip releasably attached thereto.
Figure 4:
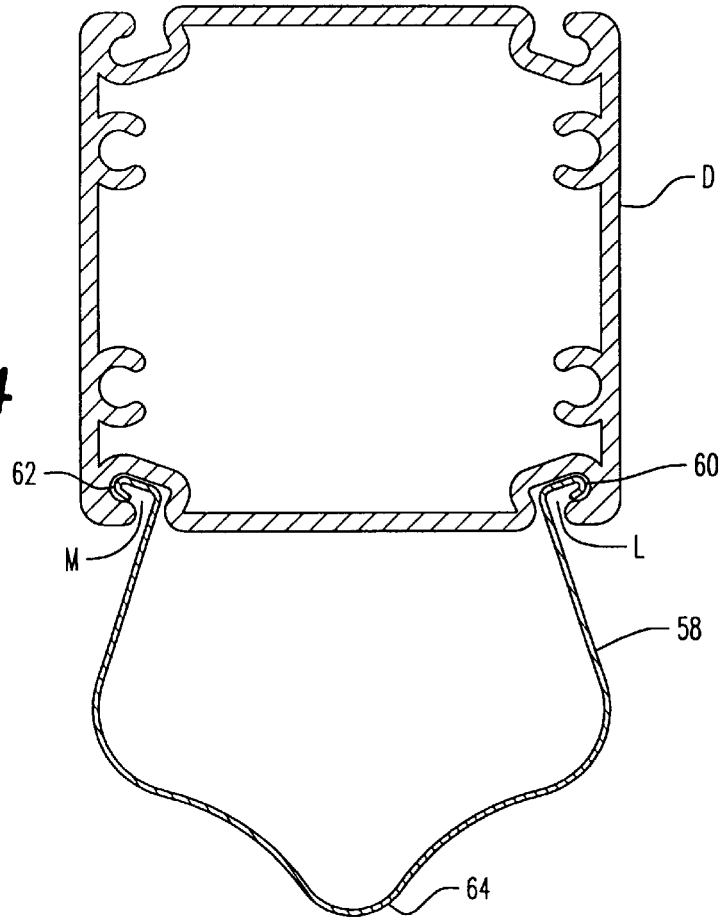
FIGS. 4 and 5 are section views similar to that of FIG. 3 showing still further embodiments of releasably engaged retaining clips.
Figure 5:
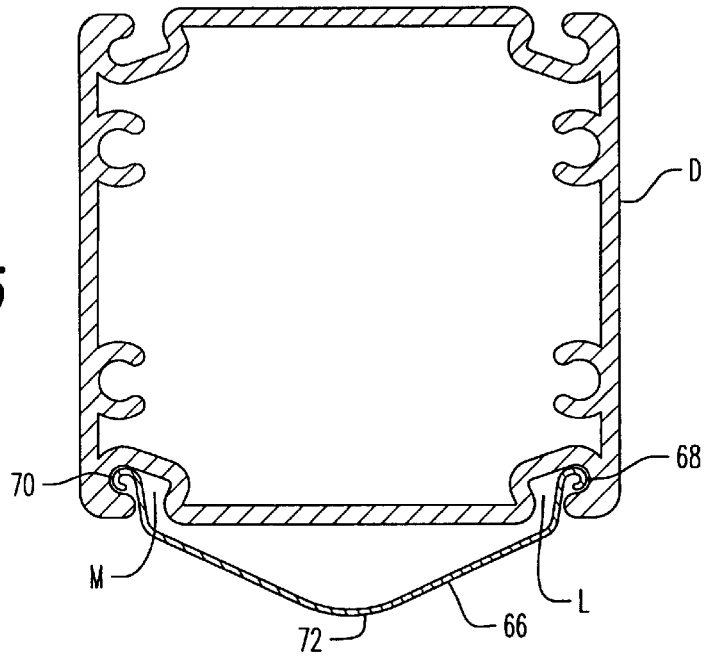

Referring now to FIGS. 3 to 5, alternate embodiments of retaining clips are shown at 48, 58 and 66, respectively. Each of these retaining clips 48, 58 and 66 are formed of resilient semirigid material such as aluminum, stainless steel or plastic material with formed ends which mechanically engage and are biasingly held within channels L and M formed inwardly along the comers of each of the frame members D. These channels L and M are typically provided in the frame members D for the alternate intended purpose of retaining an edge of a flexible screen panel and ribbing material which locks the edge of the screen panel in place in a well-known manner.

Thusly, retaining clip 48 by its formed ends 50 and 52 mechanically and biasingly engage these grooves L and M while formed ends 60 and 62 of clip 58 and 68 and 70 of clip 66 accomplish this same releasable connection thereby.

Retaining clip 48 includes a hook 54 connected at 56 to the central lower portion of retaining clip 48. This hook 54 may be utilized for supporting plants and other items of ornamentality and the like as desired within a swimming pool cage enclosure. Clips 58 and 66 which include a downwardly formed central portion 64 and 72, respectively which will support a segment of the water tubing 14 passed therethrough. Clip 66 is shown in a typical position in FIG. 1 for supporting longer portions of the water tubing 14.

As previously noted, the primary purpose of the present invention is to dispense a cloud of finely vaporized mist into the air within the confines of a swimming pool screen enclosure. The invention takes advantage of the existing or included framework structure of such caged enclosures shown typically at J in FIG. 1. By dispensing this finely atomized mist from essentially overhead within the screen enclosure, almost full evaporation of the mist occurs before it would settle onto any contents within the screened enclosure such as chaise lounges, tables, towels and other things typically found within such screened enclosures. The substantially full airborne evaporation of this fine mist occurring about the occupants, even when seated, cools the surrounding air rapidly and also may lightly collect to cool the skin of the occupants as well.

BOAT-SUPPORTED EMBODIMENT

Referring now to FIGS. 6 to 10, another embodiment of the invention is shown generally at numeral 80 and is adapted to be connectable to the tubular framework and support structure of a boat B. This embodiment 80 includes a storage or holding tank assembly 82 having a fillable tank 86 and an array of misting nozzle assemblies 84. The water storage tank assembly 82 includes a water filter 90 connectable to the outlet 88 of storage tank 86. The outlet of filter 90 is connected to the inlet side of a pump 92 which is electrically engergized by a source of electrical power (not shown) available aboard the boat B. This electrical power source may either be of a 12 volt d.c. or a 110 a.c. nature. A FLOJET Model 2100-12 type IV is preferred.

The fluid outlet of pump 92 is in the form of a highly pressurized water flow as measured and regulated by gauge 94, the outlet of which is directed to the proximal ends of a plurality of lengths of flexible water tubing 96 via a manifold 95. The water tubing 96 is concealingly deployed along support sections and tubular handrails of the boat in an unobtrusive fashion. Water flow into each of the lengths of water tubing 96 are preferably controlled by a separate valve 98. Electric control mechanisms for the pump 92 may include a preferred time delay switch for water conservation and a foot-actuated power control switch.

Disposed at the distal end 100 of each of the lengths of water tubing 96 is a misting nozzle 102 similar to that previously described. The water pressure at gauge 94 is maintained by pump 92 to deliver pressurized water for dispensing through each of the misting nozzles 102 in the range of about a maximum of 50 p.s.i.

Figure 10:
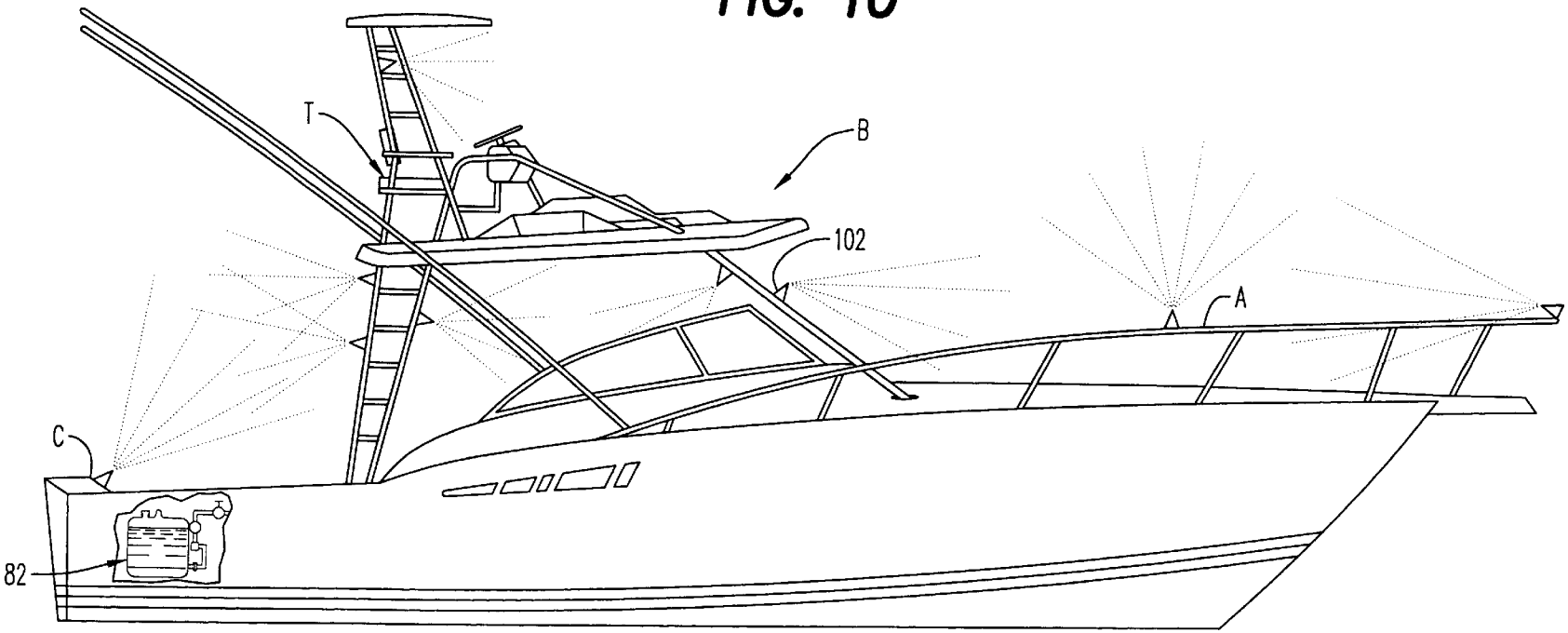
FIG. 10 is a side elevation partially broken view of a typical boat and its associated tubular framework and support structure onto which the invention is supportively attached.

As seen in FIG. 10, the storage tank assembly 82 is typically deployed atop the deck area of the boat with the pump 92 connected to an appropriate electrical power source (not shown) aboard the boat B as previously described. An array of misting nozzles shown typically at 102 are either permanently or releasably attached to various segments of the tubular framework of the boat B shown typically at A. The tubular framework A on such a boat B is in the form of a handrail or bowrail, support structure for the hard top and tuna tower T of the boat B and the like. Additionally, a portion of the misting nozzles 102 may be attached directly to unobtrusive portions of the boat structure such as a comer of the gunnel at C.

Figure 8:
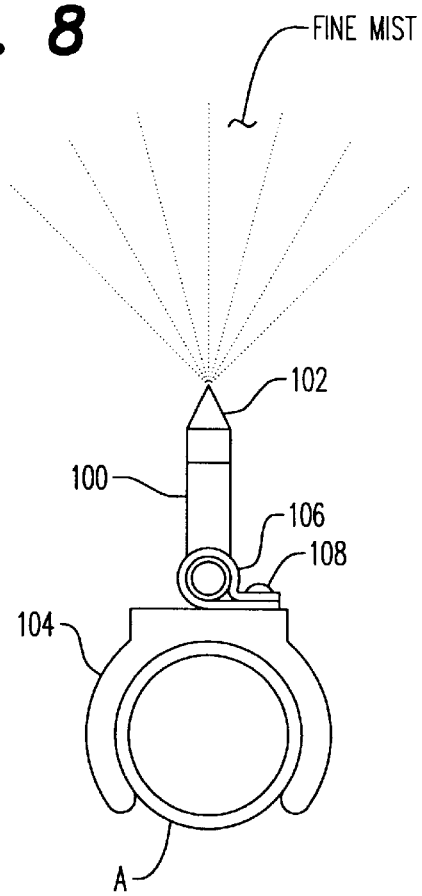
FIG. 8 is a typical end elevation view of a tubular framework of the boat such as that of a hand rail showing a misting nozzle and retaining clip attached thereto.
Figure 9:
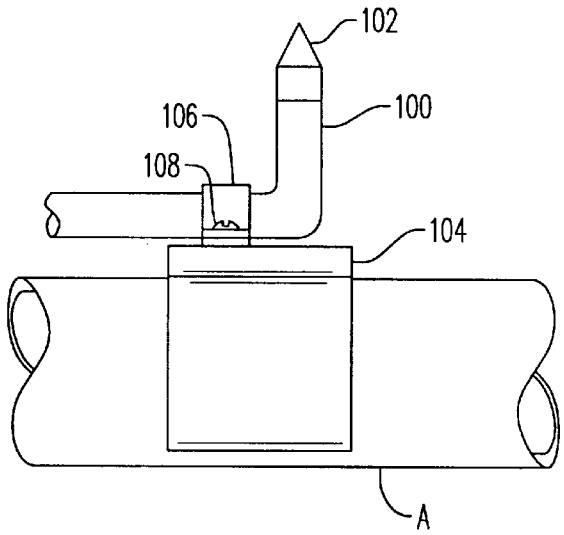
FIG. 9 is a side elevation view of FIG. 8.

As best seen in FIGS. 8 and 9, a resilient plastic clip 104 biasingly engages over the typical tubular framework A and supports the water tubing distal end portion 100 and misting nozzle 102 by a conventional clip 106 and mechanical threaded fastener 108.

By this arrangement, a suitable array of misting nozzles 102 are positionable around each of the open occupied areas of the boat B during fishing, sunbathing and the like so as to dispense a fine mist of water vapor which is substantially fully evaporated on and about the occupants of each open area before substantial wetting of the boat surfaces such as the deck, windshield and super structure of the boat B occurs. The effect of this misting arrangement is to quickly cool the occupants of each of the open areas being misted by the invention without substantial wetting of either the occupants or the nearby surface areas of the boat B themselves.

Referring particularly to FIG. 7, an alternate embodiment of the water storage tank assembly is there shown generally at numeral 104. The storage tank 106 is connectable at 114 to a SCUBA tank 108 containing highly pressurized air. Such a SCUBA tank 108 is typically found associated with boats for SCUBA diving and is selected as an alternate pressure source on the basis of ready availability thereof.

The SCUBA tank 108 includes a first stage pressure regulator 110 which reduces the outlet pressure of the air within the SCUBA tank 108, when fully charged with compressed air, from about 3,000 p.s.i. down to 150 p.s.i. A gauge 112 is also provided to further reduce the air pressure being delivered into the water storage tank to be in the range of about 50 to 60 p.s.i. The water tank outlet 116 is connectable to a water conduit 118 which is, in turn, connectable to the array of misting nozzles 102 as previously described in FIG. 6. By this arrangement, the SCUBA tank 108 easily delivers an excellent and economical and self-sufficient source of compressed air into the water storage tank 106 on a continuous basis and typically for the duration of a typical outing aboard the boat B.

Should the water supply within tank 86 of FIG. 6 be depleted, the connection to the outlet 88 may be disconnected and reconnected to the chilled water in a food or beverage cooler which has resulted from the melting of ice therein. The obvious additional benefit of chilled water being discharged from misting nozzles 102 is substantial.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A boat-supported water misting and cooling apparatus, the boat including elongated rigid tublar frame members of the type forming a handrail, a bow rail and a superstructure support, said apparatus being concealingly connected to the frame members, comprising:

a plurality of water misting nozzles each of which discharge water under pressure as a very fine mist;

a source of pressurized water;

flexible water tubing operably connected to each said misting nozzle for delivering pressurized water from said source of pressurized water to each said misting nozzle;

a proximal end of said water tubing in fluid communication with said pressurized water source;

a plurality of retaining clips each connectable to one of the frame members and supporting one said misting nozzle and said water tubing, said water tubing adapted in size and flexibility to be deployed in a substantially concealed manner along and against the frame member adjacent open deck and seating areas of the boat whereby mist discharging from said misting nozzles is distributed to cool occupants in the open areas of the boat;

said source of pressurized water is a tank of pressurized air whose output of pressurized air is directed into a sealable holding tank containing water.

2. A boat-supported water misting and cooling apparatus, the boat including elongated rigid tubular frame members of the type forming a handrail, a bow rail and a superstructure support, said apparatus being concealingly connected to the frame members, comprising:

a plurality of water misting nozzles each of which discharge pressurized water as a very fine mist sufficiently atomized and of a limited flow volume such that said mist substantially evaporates before substantial moisture accumulation occurs on any exposed surfaces of the boat;

a source of pressurized water;

flexible water tubing operably connectable to said pressurized water source for delivering pressurized water to each said misting nozzle;

a plurality of retaining clips connectable to one of the frame members for supporting one said misting nozzle and said water tubing along the frame member, said water tubing adapted in size and flexibility to be deployed in a substantially concealed manner adjacent an open area of the boat whereby mist discharging from said misting nozzles is distributed substantially only to cool occupants of the open area;

said source of pressurized water is a tank of pressurized air whose output of pressurized air is directed into a sealable holding tank containing water.

3. A boat-supported water misting and cooling apparatus, the boat including open areas with adjacent elongated rigid frame members of the type forming a handrail, a bow rail and a superstructure support, said apparatus being concealingly connected to the frame members, comprising:

a plurality of water misting nozzles each of which discharge water under pressure as a very fine mist;

a source of pressurized water;

flexible water tubing operably connectable to each said misting nozzle for delivering pressurized water from said source of pressurized water to each said misting nozzle;

a plurality of generally U-shaped clamping brackets each connectable to one of the frame members and connectedly supporting one said misting nozzle and said water tubing alone the frame members, said water tubing adapted in size and flexibility to be deployed in a substantially concealed manner overhead of and adjacent to the open area whereby mist discharging from said misting nozzles is distributed substantially only to cool occupants in the open area;

said source of Pressurized water is a tank of pressurized air whose output of pressurized air is directed into a sealable holding tank containing water.

* * * * *

UNITED STATES PATENT AND TRADEMARK OFFICE

CERTIFICATE OF CORRECTION

PATENT NO. : 6,175,969

DATED : January 23, 2001

INVENTOR(S) : Hugh A. Edwards

It is certified that error appears in the above-indentified patent and that said Letters Patent is hereby corrected as shown below:

Column 6, line 56, replace "alone" with -- along --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*